US011604054B2

(12) United States Patent
Kruger et al.

(10) Patent No.: US 11,604,054 B2
(45) Date of Patent: Mar. 14, 2023

(54) SHOCK TUBE EVENT VALIDATION

(71) Applicant: DETNET SOUTH AFRICA (PTY) LTD, Johannesburg (ZA)

(72) Inventors: Michiel Jacobus Kruger, Johannesburg (ZA); Daniel Auguste Maurissens, Orbe (CH); Andre Louis Koekemoer, Boksburg (ZA); Albertus Abraham Labuschagne, Brakpan (ZA)

(73) Assignee: DETNET SOUTH AFRICA (PTY) LTD, Johannesburg (ZA)

( * ) Notice: Subject to any disclaimer, the term of this patent is extended or adjusted under 35 U.S.C. 154(b) by 132 days.

(21) Appl. No.: 17/422,041

(22) PCT Filed: Jan. 24, 2020

(86) PCT No.: PCT/ZA2020/050007
§ 371 (c)(1),
(2) Date: Jul. 9, 2021

(87) PCT Pub. No.: WO2020/160573
PCT Pub. Date: Aug. 6, 2020

(65) Prior Publication Data

US 2022/0099422 A1 Mar. 31, 2022

(30) Foreign Application Priority Data

Jan. 28, 2019 (ZA) ..... 2019/00564

(51) Int. Cl.

| | |
|---|---|
| ***F42C 15/36*** | (2006.01) |
| ***F42C 15/40*** | (2006.01) |
| ***F42D 1/04*** | (2006.01) |
| ***F42D 1/045*** | (2006.01) |

(52) U.S. Cl.
CPC ..... *F42C 15/36* (2013.01); *F42C 15/40* (2013.01); *F42D 1/043* (2013.01); *F42D 1/045* (2013.01)

(58) Field of Classification Search
CPC ..... F42C 15/36; F42C 15/40; F42D 1/043; F42D 1/045
See application file for complete search history.

(56) References Cited

U.S. PATENT DOCUMENTS

| | | | | |
|---|---|---|---|---|
| 4,869,171 | A * | 9/1989 | Abouav | F42C 15/40 102/206 |
| 8,967,048 | B2 | 3/2015 | Harding et al. | |
| 2011/0155012 | A1 | 6/2011 | Perez Cordova et al. | |
| 2022/0082362 | A1* | 3/2022 | Kruger | F42C 7/00 |

OTHER PUBLICATIONS

International Preliminary Report on Patentability for PCT/ZA2020/050007, international filing date of Jan. 24, 2020, date of completion Nov. 13, 2020, 8 pages.
International Search Report for PCT/ZA2020/050007, international filing date of Jan. 24, 2020, dated May 19, 2020, 4 pages.
Written Opinion for PCT/ZA2020/050007, international filing date of Jan. 24, 2020, dated May 19, 2020, 5 pages.

* cited by examiner

*Primary Examiner* — J. Woodrow Eldred
(74) *Attorney, Agent, or Firm* — Cantor Colburn LLP

(57) ABSTRACT

A detonator which is initiated by a shock tube event which is validated if a processor determines that a fusible link was not fused by a shock tube event at a predetermined time interval before light generated by the shock tube event is detected.

2 Claims, 2 Drawing Sheets

SHOCK TUBE EVENT VALIDATION

CROSS-REFERENCE TO RELATED APPLICATIONS

This application is a U.S. national stage application of International Application No. PCT/ZA2020/050007 entitled "SHOCK TUBE EVENT VALIDATION", which has an international filing date of 24 Jan. 2020, and which claims priority to South African Patent Application No. 2019/00564, filed 28 Jan. 2019.

BACKGROUND OF THE INVENTION

This invention relates to a detonator which is initiated by a shock tube. This type of arrangement is described for example in the specification of U.S. Pat. No. 8,967,048.

To prevent inadvertent firing of the detonator those characteristics which are uniquely associated with a shock tube event and which are used to initiate a detonator firing process must be validated. For example, if a light signal associated with a shock tube event is to be detected, then a technique must be adopted to ensure that a light signal, produced by an extraneous source, is not mistaken to be a light signal associated with the shock tube event.

The invention is concerned with a detonator which addresses the aforementioned requirement.

SUMMARY OF THE INVENTION

The invention provides a detonator which is configured to be connected to an end of a shock tube which, upon ignition, generates a shock tube event at an end of the shock tube, the detonator including at least a first sensor and a second sensor, a processor and a timer, and wherein the first sensor upon detecting a first characteristic associated with the shock tube event transmits a first signal at a time $T_0$ to the processor and, at a time $T_1$ which is at a predetermined time interval $P_1$ before the time $T_0$, the processor determines whether the second sensor had sensed a shock tube event.

The first sensor may be a light sensor.

The second sensor may include a fusible link, i.e. the second sensor is responsive to a second characteristic, of a shock tube event, which is different from the first characteristic.

The shock tube event may be validated if, at the time $T_0$, the fusible link was integral and if, at a time $T_2$, after the first characteristic, the fusible link was in a fused state.

BRIEF DESCRIPTION OF THE DRAWINGS

The invention is further described by way of example with reference to the accompanying drawings in which.

DESCRIPTION OF PREFERRED EMBODIMENT

Figure 1:
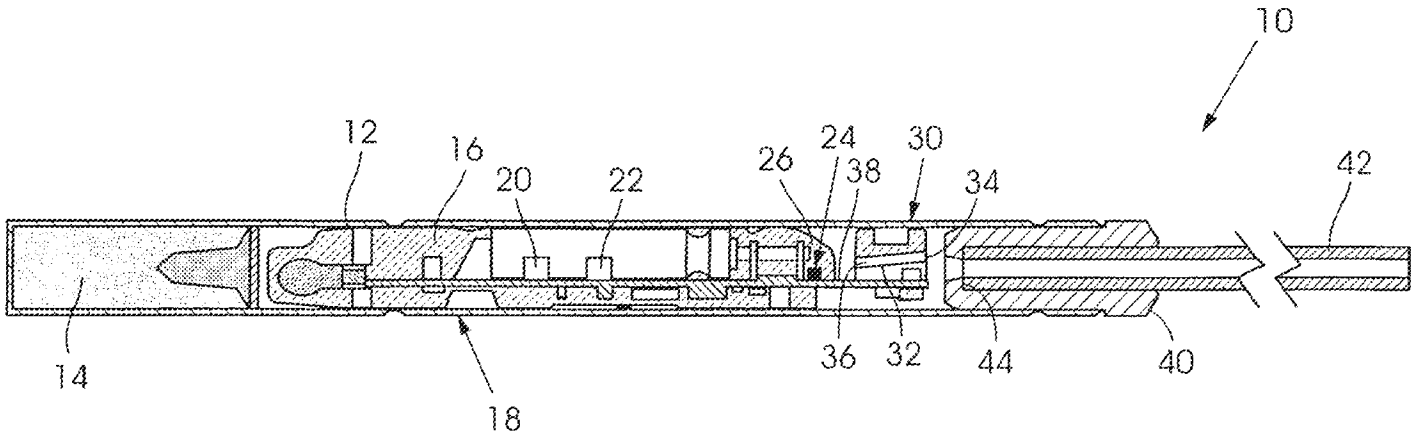
FIG. 1 illustrates schematically components of a detonator according to the invention connected to an end of a shock tube.

FIG. 1 of the accompanying drawings illustrates components of a detonator 10 according to the invention.

The detonator 10 includes a tube 12 which houses a base charge 14 at one end of the tube. Adjacent and slightly spaced from the base charge 14 is an electronic module 16. An understanding of the full nature of the module 16 is not necessary for the purposes of this specification. The module 16 includes various electronic components collectively designated with the reference numeral 18, a processor 20 and a timer 22. A light sensor 24 encased in a protective transparent plastics housing 26 is at one end of the module 16. Also located at this end is a housing 30. A passage 32 extends through the housing 30. The passage is tapered so that it is of reducing cross sectional area from an inlet 34 to an outlet 36. At least one fusible link 38 is mounted to span an interior of the passage 32 at or close to the outlet 36. The fusible link may be one of a number of fusible links. It is also possible to replace the fusible link with a plasma pad sensor or any other sensor which is responsive in a unique, repetitive and reliable manner to a chosen characteristic in a shock tube event.

The tube 12 is configured so that an open end 40 thereof can be connected to a shock tube 42 with an end 44 of the shock tube facing the inlet 34 to the passage 32.

When the shock tube 42 is fired a shock tube event is generated at the end 44. The expression "shock tube event" is used in a generic sense to designate a complex process in which a pressure wave is emitted by the shock tube 42. The pressure wave is accompanied by the emission of plasma and light. There is also a temperature rise associated with the shock tube event. Other characteristics uniquely related to the shock tube event are not referred to herein.

Figure 2:
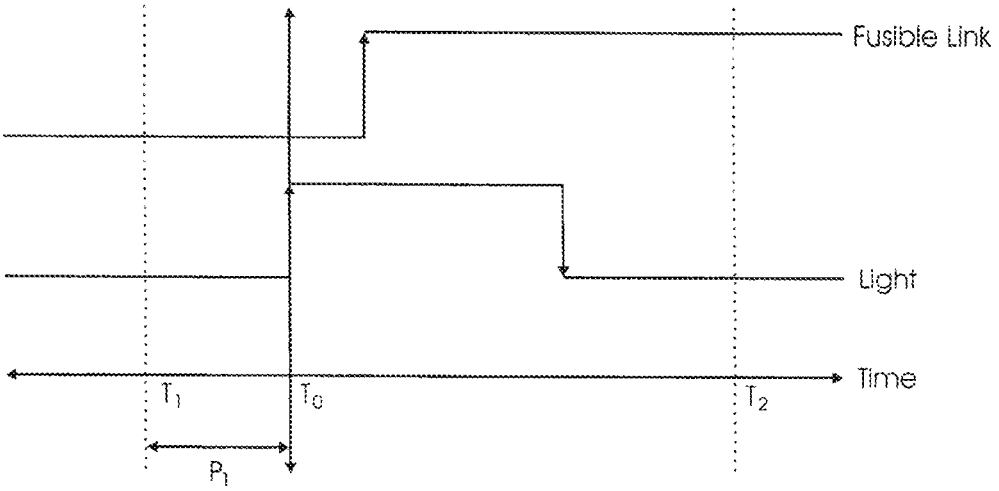
FIG. 2 shows a series of time events used in the validation process of the invention.

Referring to FIG. 2, when light from the shock tube event is detected by the light sensor 24, this is regarded as a trigger factor which occurs at time $T_0$. A signal is then sent by the light sensor 24 to the processor 20.

Prior to the ignition of the shock tube 42 and upon connection of the tube 12 to the detonator 10, the processor 20 is rendered operative so that it continuously monitors the status of the fusible link 38. This monitoring process is not dependent on the detection of light by the light sensor 24.

The processor 20 determines from its monitoring records whether the fusible link 38 was integral or not at a time $T_1$ which is at the commencement of a time period $P_1$ of predetermined duration before the time $T_0$. An essential requisite for verification and validation is that at the time $T_1$ the fusible link 38 must be integral. This means that a pressure wave had not passed through the shock tube 42 prior to the time $T_0$, i.e. no shock tube event had occurred.

Subsequently, through the use of one or more additional sensors, details of which are not described hereinafter, the detonator 10 ascertains whether further characteristics associated with a shock tube event have occurred and if so, these are subjected to a validation or confirmation process which can be effected in any convenient manner to ensure reliability.

When a first designated characteristic of a shock tube event is detected (typically this is a light signal although additionally or alternatively other characteristics may be employed), an essential part of the validation process is that prior to the detection of the first designated shock tube event no other distinct, chosen shock tube event had occurred. The last-mentioned factor is implemented, in this example, by ensuring that a pressure wave has not previously been detected. Pressure wave detection, in turn, is implemented through the use of one or more fusible links 38. The status of each fusible link 38 is continuously monitored by the processor upon connection of the detonator to a blasting circuit.

Figure 3:
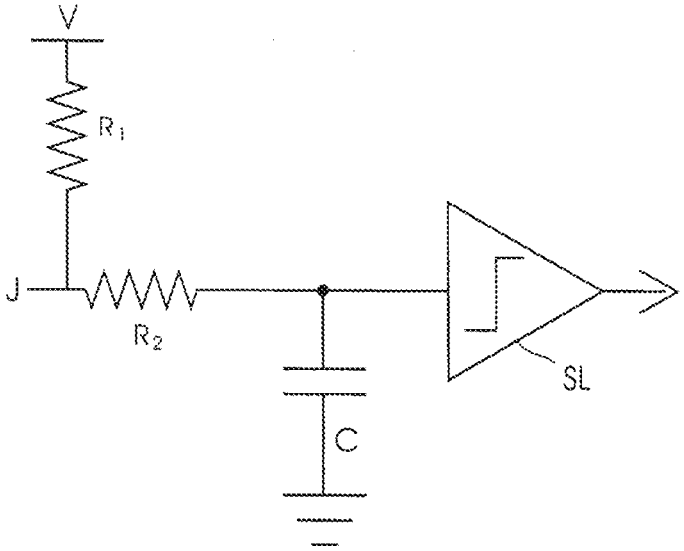
FIG. 3 shows a circuit for monitoring the status of a fusible link.

In order to monitor that status of the fusible link 38 use is made of the circuit shown in FIG. 3 which includes resistors $R_1$ and $R_2$, a capacitor C and a sensing logic unit SL. A voltage V is applied to the resistors and the capacitor. The capacitor C is then charged slowly with a time constant $(R_1+R_2)$ C. The voltage V across the capacitor C is monitored by the logic unit SL.

At the time $T_0$ if the output of the logic unit SL is below a threshold value this is indicative that, at the time $T_1$, a pressure wave had not been incident on the fusible link 38.

If a pressure wave strikes the fusible link 38 then a signal is applied to a point J which is at a junction of the resistors R1 and R2. The capacitor C then charges to a higher value and if at the time $T_0$ the output of the logic unit SL is above a threshold value then existence of the pressure wave prior to the time $T_0$ is confirmed.

If a genuine shock tube event has occurred then, due to pressure and temperature effects, the fusible link 38, which is fully exposed to the end 44 of the shock tube 42 which emits the shock tube event, ought to have been fused and, typically, would have been fully vaporized. If the fusible link 38 is in a series-connected circuit of any appropriate kind then the fusing of the link 38 establishes an open-circuit condition which is readily detected.

The signals which are detected in the aforementioned manner by the sensors and evaluated by the processor 20 are taken to be indicative of a genuine shock tube event provided that the following states or events are confirmed:

(a) the light signal was detected at the time $T_0$; and (b) the fusible link was integral (not fused) at the time $T_1$.

At a time $T_2$ which is after the end of the light pulse, i.e. the first characteristic, the fusible link 38 must be in a fused state.

Under the aforementioned conditions the processor 20 conducts further protocols to cause initiation of the detonator 10 and firing of the base charge 14. This aspect is not important to an understanding of the invention.

The invention claimed is:

1. A detonator which is configured to be connected to an end of a shock tube which, upon ignition, generates a shock tube event at the end, the detonator including at least a first sensor, a second sensor, a processor and a timer, and wherein the first sensor upon detecting a first characteristic associated with the shock tube event transmits a first signal at a time $T_0$ to the processor and, at a time $T_1$ which is at a predetermined time interval $P_1$ before the time $T_0$, the processor determines whether the second sensor had sensed a shock tube event, characterised in that the second sensor includes a fusible link and in that the shock tube event is validated if, at the time $T_0$, the fusible link was integral and if, at a time $T_2$, which is after the end of the first characteristic, the fusible link was in a fused state.

2. A detonator according to claim 1 wherein the first sensor is a light sensor.

* * * * *